United States Patent [19]

Palau

[11] 4,326,562

[45] Apr. 27, 1982

[54] DOBBIES FOR FORMING THE SHED ON WEAVING LOOMS

[75] Inventor: Joseph Palau, Duingt, France

[73] Assignee: S.A. des Etablissements Staubli (France), Fauerges, France

[21] Appl. No.: 108,244

[22] Filed: Dec. 27, 1979

[30] Foreign Application Priority Data

Feb. 13, 1979 [FR] France ..... 79 04463

[51] Int. Cl.[3] ..... D03C 1/26; D03C 1/06

[52] U.S. Cl. ..... 139/68; 139/71

[58] Field of Search ..... 139/66 R, 67, 68, 71, 139/72, 74

[56] References Cited

U.S. PATENT DOCUMENTS 4,187,886 2/1980 Palau ..... 139/68

FOREIGN PATENT DOCUMENTS 1940100 2/1971 Fed. Rep. of Germany ..... 139/71

2638058 8/1977 Fed. Rep. of Germany ..... 139/68

201595 8/1923 United Kingdom ..... 139/71

*Primary Examiner*—Henry Jaudon

*Attorney, Agent, or Firm*—Dowell & Dowell

[57] ABSTRACT

The present invention relates to dobbies of the type in which each double swinging lever is controlled by two pulling hooks cooperating with pulling knives with reciprocal movement. Each non-selected pulling hook in each pair is raised away from the associated pulling knife by a stirrup coupled to a vertical rod having a gripper at its upper end, the gripper being selectively coupled to a raising knife under the control of the reading mechanism. The raising knife is raised or lowered by a vertical slide mechanism which is coupled directly by a connecting rod to a lowering knife of the dobbie, so that the slide mechanism and raising knife move up and down synchronously therewith. The invention finds particular application in the textile industry.

1 Claim, 3 Drawing Figures

DOBBIES FOR FORMING THE SHED ON WEAVING LOOMS

The present invention relates to devices known under the name of "dobbies" and intended to be associated with weaving looms with a view to forming the shed, and it concerns more particularly the mechanisms in which the double swinging levers are actuated, not directly by crosspieces performing a reciprocating movement, but by pulling hooks.

As shown schematically in FIG. 1 of the accompanying drawings, a typical prior art dobby generally comprises a reading mechanism 1 of the punched card and needle type, each group of four needles ensuring the control of two push rods 2 (one push rod for forward operation, another for reverse motion or "unweaving") which, according to whether or not they are selected by the design, i.e. according to whether or not the corresponding part of this design presents perforations, move axially against return springs 17, or else return to rest position.

Each push rod 2 is coupled to a vertical rod 3 of which the lower end carries a stirrup member 4 provided with an eye through which a pulling hook 5 freely passes. The two hooks 5 are pivoted on the opposite ends of a double swinging lever 6 mounted on a pivot 7 itself carried by an actuating lever 8. This latter is supported by a fixed shaft 9 and is coupled by a connecting rod 10 to the lever or pulling cable associated with one of the heddle frames of the loom. Two fixed transverse stops 11 are provided at one of the ends of the reciprocating pivoting stroke of the double swinging lever 6, this pivoting movement provoking the to and fro actuation of the rod 10 and the corresponding frame.

The pulling hooks 5 present at their free end a downwardly facing nose so as to cooperate with an edge made on one or the other of two knives 12, performing a reciprocating movement. It will be noted that to each of these knives 12 there is coupled, by a system of connecting rods (not shown), a transverse stop 13 which therefore moves in reciprocating manner at the same time as the corresponding knife. The lowering of one of the hooks 5 with a view to its being seized by one of the knives 12 is effected by two knives 14 carried by sleeves 15 clamped on two transverse shafts 16 performing an angular oscillating movement. During the return of the knives 12 in the direction of seizing position, one of two sequences may occur:

either the hook 5 has been selected by the reading mechanism, in which case the corresponding stirrup 4 is maintained in low position, the upper hook 5 having been taken by the knife 12 as shown in FIGS. 1 and 2;

or the hook 5 has not been selected, because the push rod 2 was not actuated by the mechanism 1 and returned leftwardly to its rear position under the effect of its return spring 17, each stirrup 4 having a certain clearance on the lower toothed member 18 which allows tilting of the rod 2 but ensures its vertical guiding.

In this latter case, the hook 5 which has not been selected must of course be raised in order to allow it to escape the action of the corresponding knife 12. To this end, there are provided in the conventional dobbies two upper knives 19 to which a cam mechanism 20 imparts a reciprocating vertical displacement synchronized with that of the lowering knives 14; these knives 19 are intended to cooperate with grippers 21 fixed to the top of the rods 3 and they are disposed so as to seize the gripper 21 of the stirrups whose push rod 2 has returned into rear position.

It will be readily appreciated that the functioning of such a dobby involves an exact synchronization of the knives 12, 14 and 19, so that the least error in the initial adjustment or the least untimely misadjustment during functioning not only provokes stoppage of the loom, but also risks seriously damaging the dobby.

The object of the improvements forming the subject matter of the present invention is to obviate this drawback, whilst simplifying the construction of the dobby, by providing direct interconnection of the knives 14 with the knives 19 that raise the rods 3, while eliminating the cam mechanism 20.

In accordance with the invention, the non-selected hooks are raised with the aid of knives which are directly coupled by connecting rods and slide members actuated by the oscillating lowering knives, so as to be moved vertically during each oscillation of the latter and thus to cooperate with a gripper carried by each stirrup member.

The invention will be more readily understood on reading the following description with reference to the accompanying drawings, in which:

FIG. 1 schematically illustrates the arrangement of a conventional prior art dobby, as indicated hereinabove.

Figure 1:
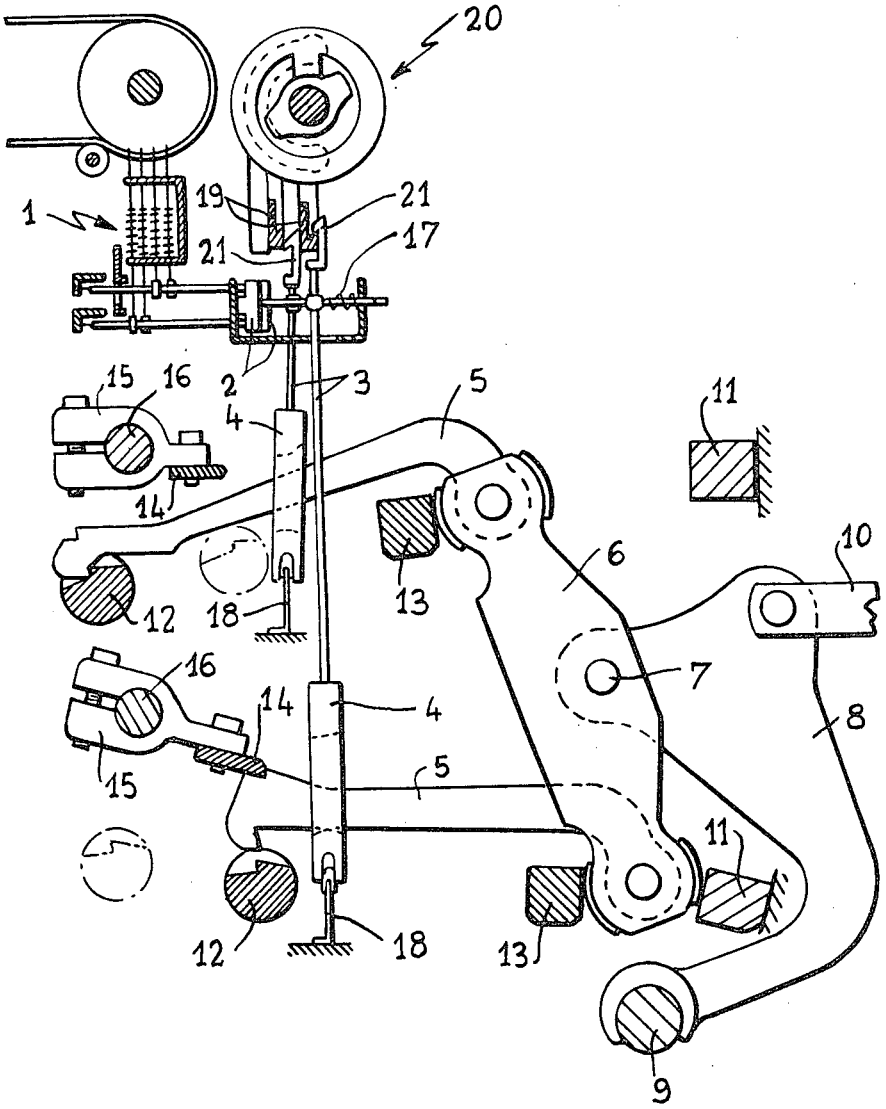
Fig. 1 PRIOR ART

In the dobby shown in FIG. 2 there is found again a reading mechanism 1, two push rods 2 for each heddle frame, two hooks 5 associated with an assembly 6-7-8-9-10, two oscillating knives 14, two reciprocating pulling knives 12 coupled to two mobile stops 13, and two stirrup members 4 suspended from rods 3 controlled by the push rods 2 as described above. However, unlike the conventional construction, the raising knives 19 intended for raising the stirrup members 4 are actuated, not by an independent cam mechanism, but by two mechanisms with connecting rods 204 and slide members 201, the mechanism visible in FIG. 2 having been given the general reference 200.

Figure 3:
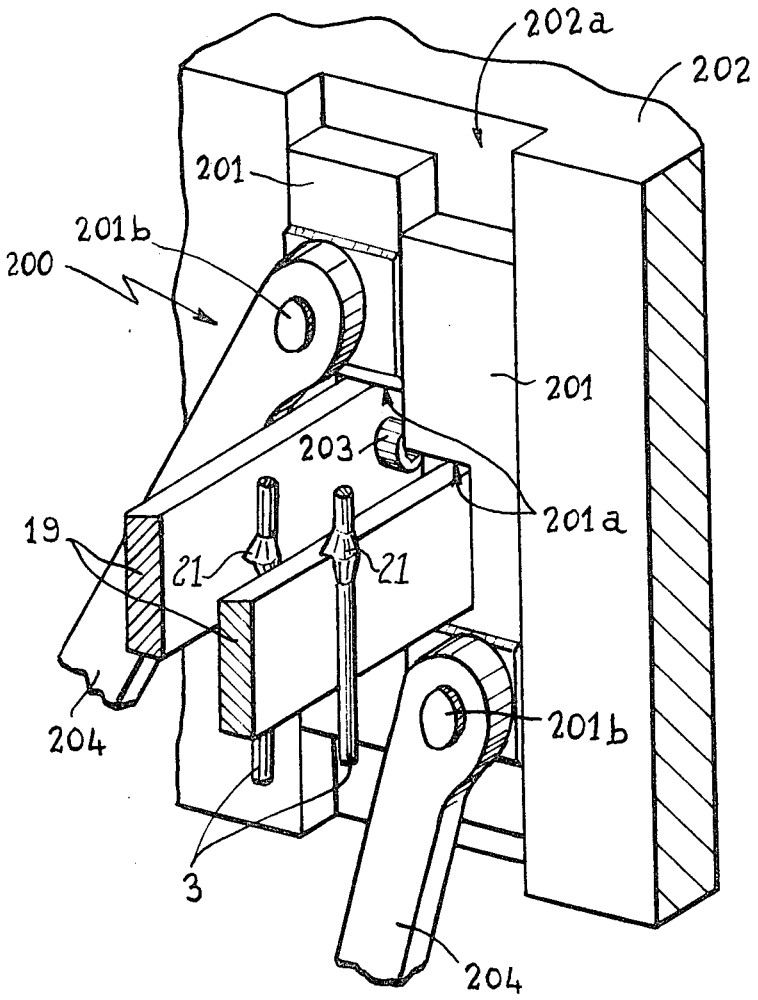
FIG. 3 shows, in perspective, one of the two mechanisms composed of connecting rods and slide members for coupling the raising knives to the lowering knives.

As is more particularly visible in FIG. 3, each mechanism 200 comprises two slide members 201 machined so as to move side by side independently of each other inside a vertical guide **202*a* made in the corresponding side wall 202 of the frame of the dobby, the displacement of said slide members being made with a clearance which is as close as possible. The inner vertical edge of each slide member 201 is provided with a cut 201*a* inside which one of the two knives 19 is engaged and fixed, for example with the aid of a screw such as 203**.

A connecting rod 204 is associated with each of the slide members 201, the upper end of said rod pivoting on a lateral pin **201*b* of the sliding member in question, whilst the lower end pivots at the end of a cheek 205 (FIG. 2) added to the corresponding sleeve 15 of the upper or lower lowering knife 14. Under these conditions, it will be understood that the oscillating movement imparted to the lowering knives 14 is transmitted by the connecting rods 204 to the slide members 201 which therefore move vertically inside the lateral guides 202*a***.

Figure 2:
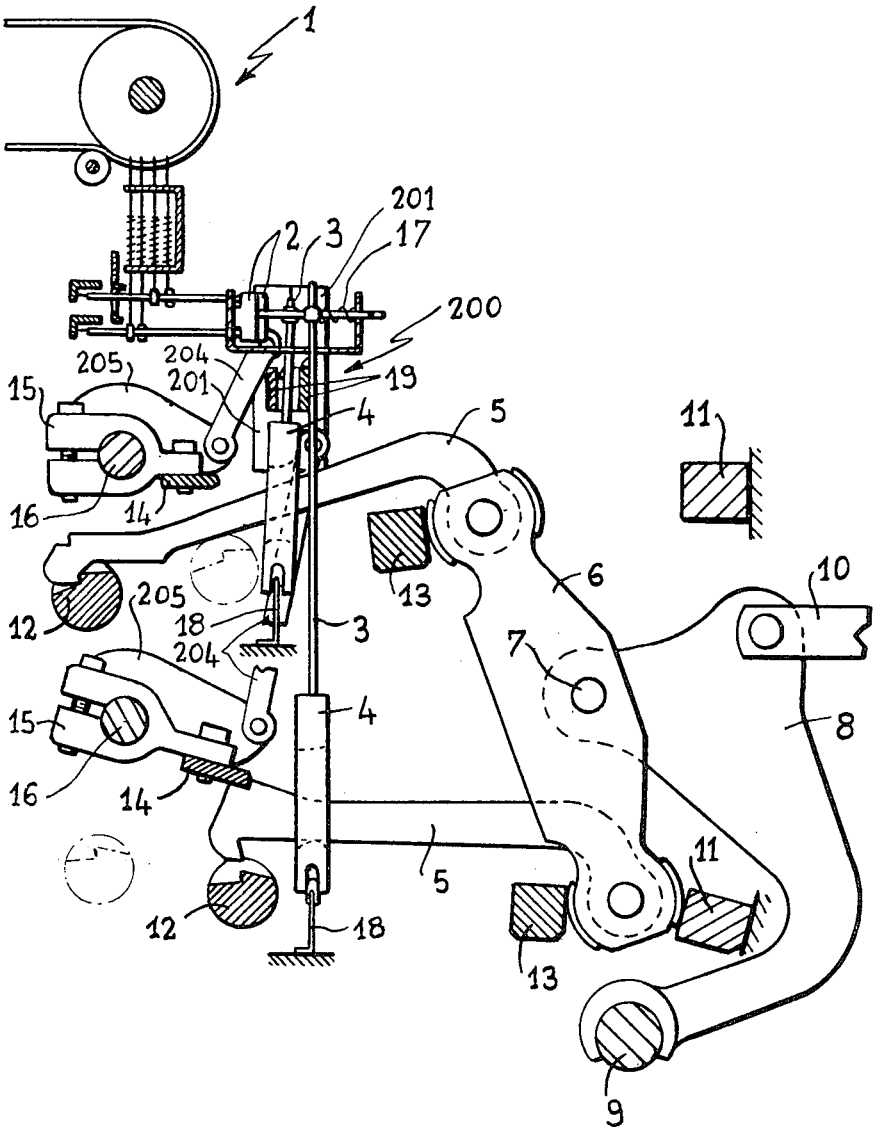
FIG. 2 shows, in the same way, the general arrangement of a dobby according to the invention.

The functioning of the dobby according to FIG. 2 is substantially identical to that set forth with reference to FIG. 1, in that the lowering of the hooks 5 is effected with the aid of the two oscillating knives 14 which displace the nose of said hooks to come into engagement with the pulling knives 12, thus controlling the actuating levers 8 of the dobby alternately.

When the reading mechanism actuates the rightward axial displacement of the push rods 2 to the front, the rods 3 each corresponding with whichever of the hooks 5 is thus selected are displaced toward to the front so that the knife 19 envisaged does not come into engagement, during its rising movement, with the lateral gripper 21 (FIG. 3) provided on each rod 3. The vertical movement of a displaced knife 19 therefore has no action on the stirrup members 4 in question, so that the latter remain in low position and the corresponding hooks 5 are again pulled by the knife 12.

On the contrary, when there is no selection, i.e. when the needles of the mechanism 1 do not drop into the perforations of the card or design, the push rods 2 associated remain to the rear under the effect of their spring 17, without actuating the rods 3. The latter therefore remain in rear position and their gripper 21 is consequently disposed within the vertical path of the edge of the knife 19 in question (as shown at the lower stirrup member 4 in FIG. 2). These stirrup members 4 are therefore raised, ensuring elevation of the pulling hook 5 which passes therethrough and which consequently escapes the oscillating knife 12.

Finally, the invention makes it possible to do without the cam mechanism 20 of the conventional art, this substantially simplifying the construction of the dobby and reducing the cost thereof. Moreover, and in particular, the lowering of the pulling hooks 5 and their elevation in the case of non-selection are effected by the same assembly 15-16, thereby considerably limiting the risks of misadjustment. It will further be noted that the elimination of the mechanism 20 allows a better access to the assembly 1-2 and consequently facilitates maintenance thereof.

What is claimed is:

1. In a dobby for controlling the shed of a weaving loom, the dobby being of the type having multiple double swinging levers coupled respectively to loom heddle frames, the levers being displaceable by associated pulling hooks respectively located adjacent to pulling knives, each pulling hook being displaceable downwardly for coupling with a pulling knife by a lowering knife and being displaceable upwardly away from the pulling knife by a stirrup whose upward displacement is under the control of a reading mechanism, the improvement comprising:

(a) a pair of vertical slide means;

(b) a connecting rod coupling each slide means with a lowering knife to raise and lower the slide means synchronously therewith;

(c) raising knife means carried by, and operative to be raised and lowered by each slide means;

(d) a gripper coupled with each stirrup and located adjacent to a raising knife; and (e) means under the control of the reading mechanism for selectively moving the gripper into or out of contact with a raising knife.

* * * * *